US005833845A

United States Patent [19]

Anderson

[11] Patent Number: 5,833,845

[45] Date of Patent: Nov. 10, 1998

[54] LEAF SKIMMER SYSTEM

[76] Inventor: Richard L. Anderson, 14 Black River Ct., Sacramento, Calif. 95831

[21] Appl. No.: 762,282

[22] Filed: Dec. 9, 1996

[51] Int. Cl.[6] ..... E04H 4/16

[52] U.S. Cl. ..... 210/169; 210/416.2

[58] Field of Search ..... 209/235, 233, 209/236, 409, 417, 418; 210/169, 416.2

[56] References Cited

U.S. PATENT DOCUMENTS

| | | | |
|---|---|---|---|
| 3,706,379 | 12/1972 | Erlich | 210/169 |
| 4,140,634 | 2/1979 | Harry | 210/169 |
| 4,162,967 | 7/1979 | Gironda, Jr. | 209/235 |
| 4,198,720 | 4/1980 | Matsumoto | 209/417 |
| 4,348,281 | 9/1982 | Perry et al. | 210/169 |
| 4,426,286 | 1/1984 | Puckett et al. | 210/169 |
| 4,913,810 | 4/1990 | Hodak | 210/169 |
| 4,986,012 | 1/1991 | Majkrzak | 37/248 |
| 5,078,863 | 1/1992 | Durigon | 210/169 |
| 5,279,728 | 1/1994 | Weiss | 210/169 |
| 5,288,414 | 2/1994 | Mongiello | 210/169 |
| 5,487,830 | 1/1996 | Huppert | 210/169 |

*Primary Examiner*—Joseph E. Valenza
*Assistant Examiner*—Patrick Mackey

[57] ABSTRACT

A new Leaf Skimmer System for collecting debris and excluding debris from entering a conventional pool skimmer system thereby reducing the amount of manual removal of the debris from the pool skimmer system. The inventive device includes a rectangular frame, a reticulated netting enclosing the frame, a plurality of doors pivotally secured to the frame, a pair of support arms including a suction cup engaging a side wall of a pool, and a elongated hook member for engaging a pool skimmer. The netting collects and retains debris, such as leaves, before entering the pool skimmer. The netting includes a water passage corresponding to the pool skimmer for allowing smaller debris into the pool skimmer.

6 Claims, 3 Drawing Sheets

LEAF SKIMMER SYSTEM

BACKGROUND OF THE INVENTION

1. Field of the Invention

The present invention relates to Pool Cleaning Devices and more particularly pertains to a new Leaf Skimmer System for collecting debris and excluding debris from entering a conventional pool skimmer system thereby reducing the amount of manual removal of the debris from the pool skimmer system.

2. Description of the Prior Art

The use of Pool Cleaning Devices is known in the prior art. More specifically, Pool Cleaning Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Pool Cleaning Devices include U.S. Pat. No. 5,336,400; U.S. Pat. No. 3,932,281; U.S. Des. Pat. No. 328,778; U.S. Pat. No. 4,746,424; U.S. Pat. No. 4,089,074 and U.S. Pat. No. 4,460,462.

While these devices fulfill their respective, particular objectives and requirements, the aforementioned patents do not disclose a new Leaf Skimmer System. The inventive device includes a rectangular frame, a reticulated netting enclosing the frame, a plurality of doors pivotally secured to the frame, a pair of support arms including a suction cup engaging a side wall of a pool, and a elongated hook member for engaging a pool skimmer.

In these respects, the Leaf Skimmer System according to the present invention substantially departs from the conventional concepts and designs of the prior art, and in so doing provides an apparatus primarily developed for the purpose of collecting debris and excluding debris from entering a conventional pool skimmer thereby reducing the amount of manual removal of the debris from the pool skimmer system.

SUMMARY OF THE INVENTION

In view of the foregoing disadvantages inherent in the known types of Pool Cleaning Devices now present in the prior art, the present invention provides a new Leak Skimmer System construction wherein the same can be utilized for collecting debris and excluding debris from entering a conventional pool skimmer system thereby reducing the amount of manual removal of the debris from the pool skimmer system.

The general purpose of the present invention, which will be described subsequently in greater detail, is to provide a new Leak Skimmer System apparatus and method which has many of the advantages of the Pool Cleaning Devices mentioned heretofore and many novel features that result in a new Leak Skimmer System which is not anticipated, rendered obvious, suggested, or even implied by any of the prior art Pool Cleaning Devices, either alone or in any combination thereof.

To attain this, the present invention generally comprises a rectangular frame, a reticulated netting enclosing the frame, a plurality of doors pivotally secured to the frame, a pair of support arms including a suction cup engaging a side wall of a pool, and a elongated hook member for engaging a pool skimmer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Leaf Skimmer System apparatus and method which has many of the advantages of the Pool Cleaning Devices mentioned heretofore and many novel features that result in a new Leaf Skimmer System which is not anticipated, rendered obvious, suggested, or even implied by any of the prior art Pool Cleaning Devices, either alone or in any combination thereof.

It is another object of the present invention to provide a new Leaf Skimmer System which may be easily and efficiently manufactured and marketed.

It is a further object of the present invention to provide a new Leaf Skimmer System which is of a durable and reliable construction.

An even further object of the present invention is to provide a new Leaf Skimmer System which is susceptible of a low cost of manufacture with regard to both materials and labor, and which accordingly is then susceptible of low prices of sale to the consuming public, thereby making such Leaf Skimmer System economically available to the buying public.

Still yet another object of the present invention is to provide a new Leaf Skimmer System which provides in the apparatuses and methods of the prior art some of the advantages thereof, while simultaneously overcoming some of the disadvantages normally associated therewith.

Still another object of the present invention is to provide a new Leaf Skimmer System for collecting debris and excluding debris from entering a conventional pool skimmer system thereby reducing the amount of manual removal of the debris from the pool skimmer system.

Yet another object of the present invention is to provide a new Leaf Skimmer System which includes a rectangular frame, a reticulated netting enclosing the frame, a plurality of doors pivotally secured to the frame, a pair of support arms including a suction cup engaging a side wall of a pool, and a elongated hook member for engaging a pool skimmer.

Still yet another object of the present invention is to provide a new Leaf Skimmer System that decreases the amount of time required to run a filter system thereby reducing electricity consumption.

Even still another object of the present invention is to provide a new Leaf Skimmer System that allows a pool owner to automatically clean the water surface of debris such as leaves, insects, and other debris.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
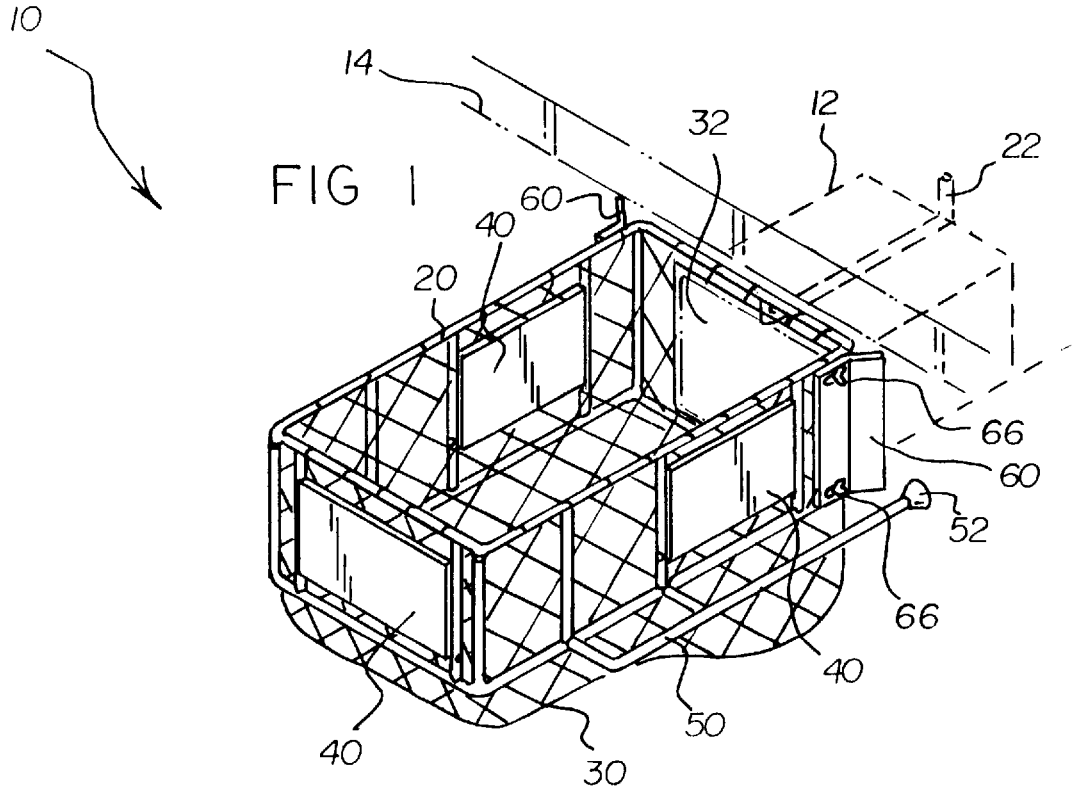
FIG. 1 is an upper perspective view of a new Leaf Skimmer System secured adjacent a pool skimmer according to the present invention.

With reference now to the drawings, and in particular to FIGS. 1 through 6 thereof, a new Leaf Skimmer System embodying the principles and concepts of the present invention and generally designated by the reference numeral 10 will be described.

More specifically, it will be noted that the Leaf Skimmer System 10 comprises a rectangular frame 20, a reticulated netting 30 secured around the rectangular frame 20 for collecting debris, at least one support arm 50 secured to the rectangular frame 20 projecting rearwardly and downwardly, and a suction cup 52 secured to the support arm 50 opposite of the rectangular frame 20 for securing to a side wall 14 of a pool for covering a pool skimmer 12.

Figure 2:
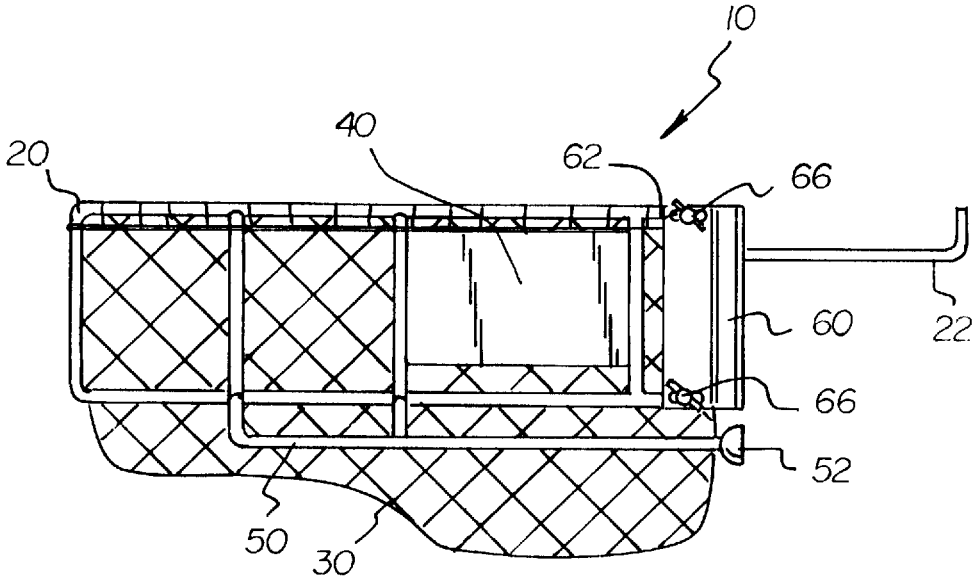
FIG. 2 is a side view of the present invention.
Figure 3:
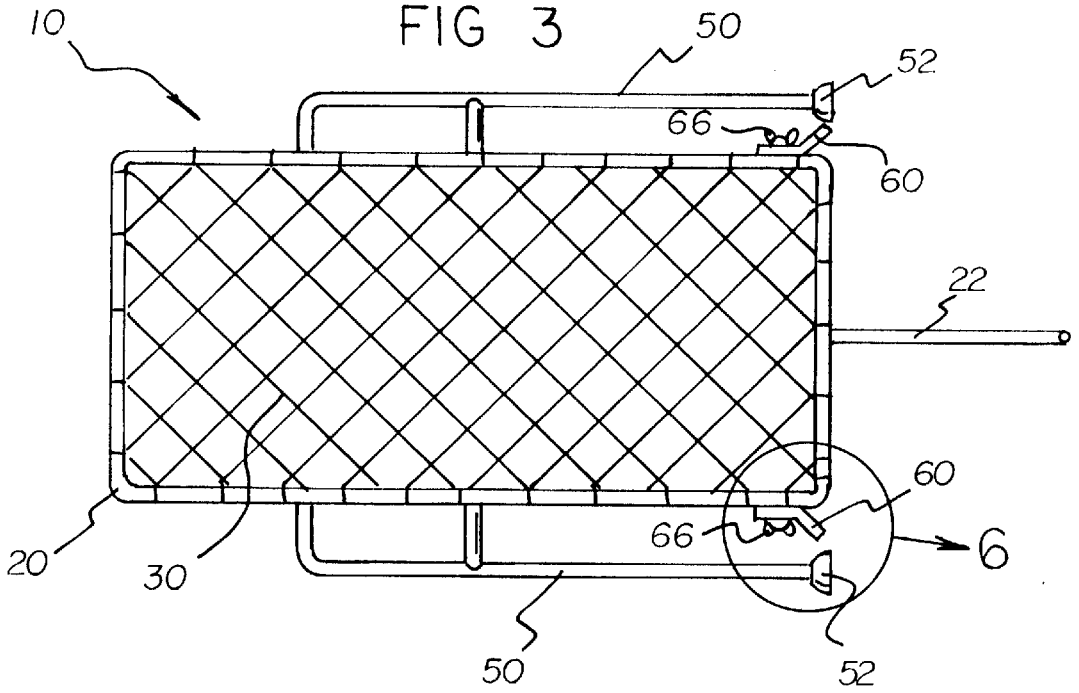
FIG. 3 is a top view of the present invention.
Figure 4:
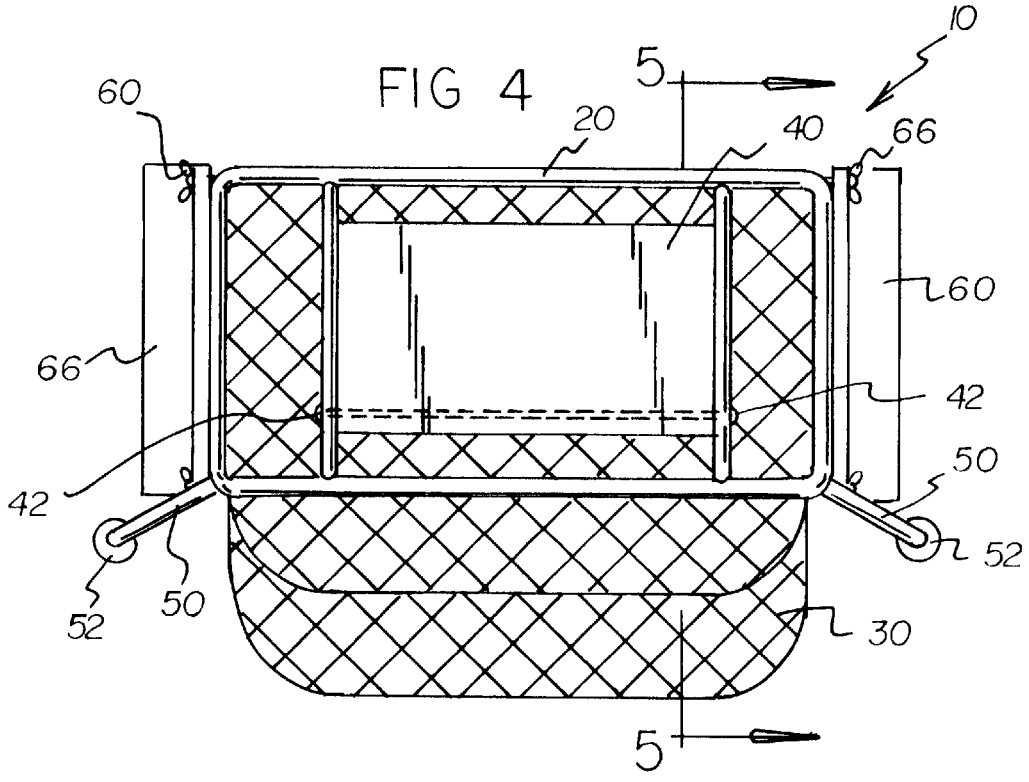
FIG. 4 is a front view of the present invention.
Figure 5:
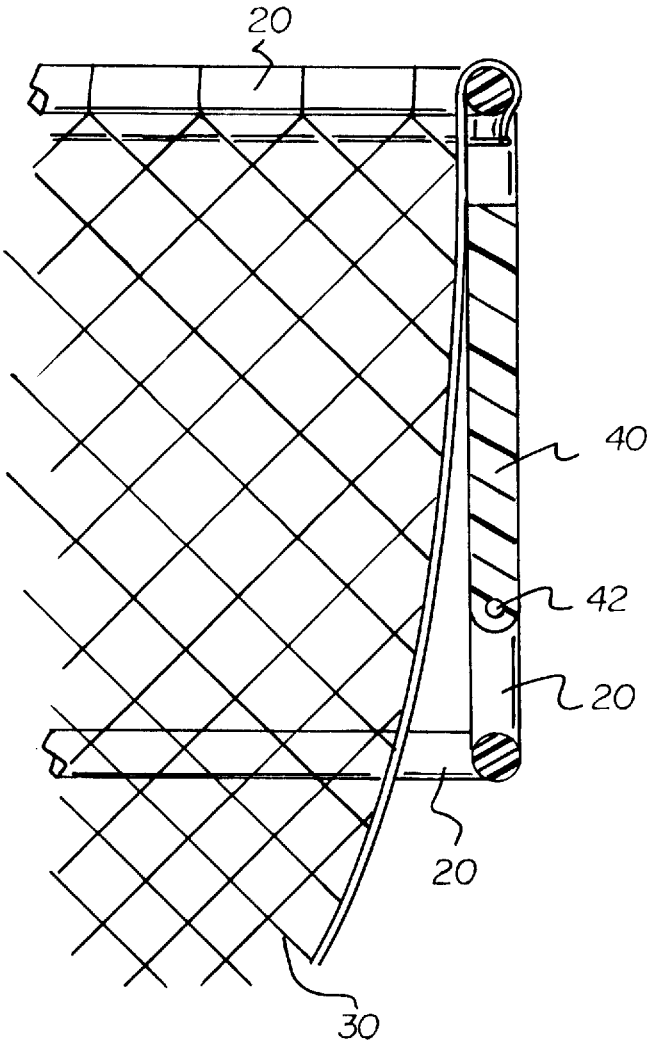
FIG. 5 is a cross sectional view taken along line 5—5 of FIG. 4.

As shown in FIGS. 1 through 3 of the drawings, an elongated hook member 22 is secured to an upper rear portion of the rectangular frame 20 for projecting into and engaging the pool skimmer 12. As best shown in FIGS. 1 and 2 of the drawings, a plurality of rectangular doors 40 are pivotally secured to the frame 20 by a pivot pin 42 projecting into a lower portion of the rectangular doors 40. The rectangular doors 40 project through an unnumbered opening within the reticulated netting 30 for allowing certain debris into the reticulated netting 30 in the event the outside portion of the reticulated netting 30 should become plugged with accumulated debris. As shown in FIG. 1 of the drawings, the reticulated netting 30 includes a water passage 32 corresponding to the pool skimmer 12 for allowing debris into the pool skimmer 12. As best shown in FIGS. 1, 2 and 4 of the drawings, the reticulated netting 30 extends downward past the rectangular frame 20 near the water passage 32 for allowing accumulation of debris during operation.

Figure 6:
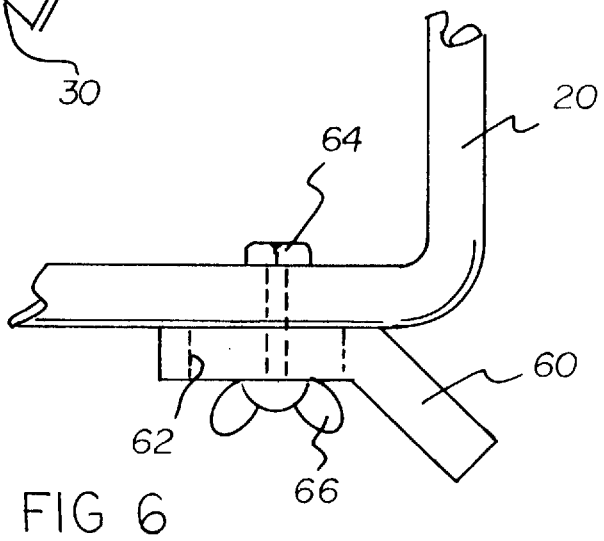
FIG. 6 is a magnified view from FIG. 3 disclosing the guide bracket.

As shown in FIGS. 1 through 6 of the drawings, at least one guide bracket 60 is adjustably secured to a rear end of the rectangular frame 20 for adjusting the position of the rectangular frame 20 within respect to the side wall 14 for allowing the elongated hook member 22 to snugly engage within the pool skimmer 12. As shown in FIG. 6 of the drawings, at least one fastener 64 is secured to the frame 20 projecting parallel to the water passage 32. At least one slot 62 projects into the guide bracket 60 for slidably receiving the fastener 64. At least one wing nut 66 threadably engages the fastener 64 with the guide bracket 60 mesially positioned for selectively engaging the guide bracket 60 to the rectangular frame 20.

In use, the user positions the rectangular frame 20 supporting the reticulated netting 30 near an opening of the pool skimmer 12. The user secures the suction cups 52 secured to the support arm 50 to the side wall 14 of the pool near the pool skimmer 12. The user thereafter inserts the elongated hook member 22 into the pool skimmer 12 and adjusts the guide bracket 60 to provide a snug fit within the pool skimmer 12 to prevent accidental removal. Debris, such as leaves, accumulate to the outside portion of the reticulated netting 30. When the debris accumulates around the reticulated netting 30 so as to prevent water flow through the reticulated netting 30, the rectangular doors 40 pivot allowing water and debris to flow into the interior portion of the reticulated netting 30 and rectangular frame 20. Thereafter, the debris accumulates into the lower portions of the reticulated netting 30 as shown in FIGS. 1 and 2 of the drawings. When the present invention has accumulated a substantial amount of debris, the user simply reverses the above stated installation process and empties the reticulated netting 30 of the accumulated debris.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A leaf skimmer system for blocking the passage of debris into a pool skimmer, said pool skimmer having a mouth opening in a vertical side wall of a pool, said leaf skimmer system comprising:

a substantially rectangular frame defining an interior, said rectangular frame having a rear portion for positioning adjacent to the mouth opening of a pool skimmer in the side wall of a pool to cover said mouth opening;

a reticulated netting secured around said rectangular frame for collecting debris from entering the interior chamber of said rectangular frame;

two support arms secured to said rectangular frame, each support arm having an end projecting rearwardly of the rear portion of said rectangular frame;

a suction cup secured to the end of each of said support arms for engaging and securing to a side wall of a pool adjacent to the mouth opening of said pool skimmer, an elongated hook member having an upwardly turned distal end, said elongated hook member being secured to an upper rear portion of said substantially rectangular frame and extending rearwardly from said frame for projecting into the mouth opening of said pool skimmer, said upwardly-turned distal be secured to the interior chamber of the pool skimmer to mount the frame in a position adjacent to the side wall of the pool regardless of the distance between the mouth opening of said pool skimmer and a top edge of the side wall, and a plurality of rectangular doors with a lower portion of said rectangular doors pivotally secured to said frame by a pivot pin and projecting through openings within said reticulated netting for allowing certain debris into said reticulated netting.

2. The leaf skimmer system of claim 1, wherein said reticulated netting includes a water passage for positioning adjacent to the mouth opening of said pool skimmer.

3. The leaf skimmer system of claim 2, wherein said reticulated netting extends downward past said rectangular frame near said water passage for allowing accumulation of debris during operation.

4. The leaf skimmer system of claim 1, including at least one guide bracket adjustably secured to the rear portion of said rectangular frame for adjusting the position of said rectangular frame with respect to the mouth opening in said side wall of said pool such that said elongated hook member is snugly engageable with said pool skimmer.

5. The leaf skimmer system of claim 1, including:

at least one fastener secured to said frame projecting parallel to said water passage;

at least one slot projecting into said guide bracket for slidably receiving said fastener; and at least one wing nut threadably engaging said fastener around said guide bracket for selectively positioning said guide bracket with respect to said rectangular frame.

6. A leaf skimmer system for attachment to a pool having an existing pool skimmer for blocking the passage of debris into said pool skimmer, said pool skimmer having a mouth opening in a vertical side wall of a pool the leaf skimmer system comprising:

a substantially rectangular frame defining an interior, said rectangular frame having a rear portion for positioning adjacent to the mouth opening of a pool skimmer in the side wall of a pool to cover said mouth opening;

netting coupled to said frame, said netting extending below said frame, said netting being adapted for collecting leaves from entering the interior chamber of said pool skimmer;

two support arms, each of said support arms having a distal end, each of said support arms being disposed from a bottom of said frame and projecting rearwardly of the rear portion of said substantially rectangular frame;

each of said support arms having a suction cup secured to the distal end, each said suction cup being adapted to engage a side wall of the pool proximate to the mouth opening of the pool skimmer;

an elongated hook, said elongated hook being disposed from a top of said frame and extending rearwardly from said frame for projecting into the mouth opening of said pool skimmer, said elongated hook having a distal end adapted to extend substantially upwards within the pool skimmer to mount the frame in a position adjacent to the side wall of the pool such that each said suction cup is held against the side wall of the pool regardless of the distance between the mouth opening of said pool skimmer and a top edge of the side wall;

a number of pivoted doors positioned around sides of said rectangular frame, said netting having a number of apertures corresponding to said number of pivoting doors, said netting apertures adapted for positioning around said pivoting doors such that debris within the pool can pass through said pivoting doors into an interior of said frame;

said netting further having an opening adapted for positioning proximate the existing pool skimmer such that the debris within the frame can pass into the pool skimmer; and at least one guide bracket adjustably secured to a rear end of said rectangular frame, said guide bracket being for adjusting the position of said rectangular frame with respect to the pool wall for allowing said elongated hook member to snugly engage within said pool skimmer.

* * * * *